US009352933B2

(12) United States Patent
Moore et al.

(10) Patent No.: US 9,352,933 B2
(45) Date of Patent: May 31, 2016

(54) INTEGRATED COMPRESSOR REEL AND TANK ASSEMBLY

(71) Applicants: Timothy Wayne Moore, Columbia City, IN (US); Edward L. Walter, Columbia City, IN (US)

(72) Inventors: Timothy Wayne Moore, Columbia City, IN (US); Edward L. Walter, Columbia City, IN (US)

(73) Assignee: AKTIEBOLAGET SKF, Gothenburg (SE)

( * ) Notice: Subject to any disclaimer, the term of this patent is extended or adjusted under 35 U.S.C. 154(b) by 365 days.

(21) Appl. No.: 14/013,425

(22) Filed: Aug. 29, 2013

(65) Prior Publication Data

US 2015/0059861 A1 Mar. 5, 2015

(51) Int. Cl.

*B65H 75/44* (2006.01)
*B65H 75/42* (2006.01)
*F04B 41/02* (2006.01)

(52) U.S. Cl.

CPC ..... *B65H 75/42* (2013.01); *B65H 75/4402* (2013.01); *B65H 75/4478* (2013.01); *F04B 41/02* (2013.01); *B65H 2701/33* (2013.01); *Y10T 137/0441* (2015.04); *Y10T 137/6914* (2015.04); *Y10T 137/6918* (2015.04); *Y10T 137/6925* (2015.04); *Y10T 137/6954* (2015.04)

(58) Field of Classification Search

CPC ..... B65H 75/425; B65H 75/4402; B65H 75/4475; F04B 41/02; Y10T 137/6914; Y10T 137/6918; Y10T 137/6925; Y10T 137/6954

USPC ..... 137/355.16, 355.26, 899.4

See application file for complete search history.

(56) References Cited

U.S. PATENT DOCUMENTS 1,428,365 A * 9/1922 Ewald ..... G07F 17/06 137/355.18
1,535,254 A * 4/1925 Russell ..... B60S 5/00 137/355.18
1,729,306 A * 9/1929 Woodford ..... B60S 5/043 137/355.18
1,767,337 A * 6/1930 Wilson ..... B60S 5/043 137/355.18
2,804,259 A * 8/1957 Ralston ..... F04B 35/06 137/899.4
2,826,354 A * 3/1958 Field ..... F04B 35/06 137/899.4
3,175,574 A * 3/1965 Morford ..... A01G 25/095 137/355.26
4,830,056 A * 5/1989 Chamberlain ..... F17C 7/00 137/545
7,073,529 B1 * 7/2006 Harkey ..... B65H 75/4402 137/355.23

FOREIGN PATENT DOCUMENTS

JP 2008056387 A * 3/2008

OTHER PUBLICATIONS

Machine translation of JP 2008056387.*

* cited by examiner

*Primary Examiner* — Kevin Murphy
(74) *Attorney, Agent, or Firm* — Mark Ussai; SKF USA Inc. Patent Dept.

(57) ABSTRACT

A compression system and method of manufacturing a compression system are provided. The compression system includes a compressor, and a tank rotatably coupled with the compressor and configured to receive a compressed fluid therefrom. The compression system further includes a sheave configured to receive a hose, with the sheave being coupled with the tank such that the sheave and the tank are rotationally fixed relative to one another and rotatable with respect to the compressor.

16 Claims, 4 Drawing Sheets

INTEGRATED COMPRESSOR REEL AND TANK ASSEMBLY

BACKGROUND

Air compressors typically include a driver and a compression mechanism, which ingests, pressurizes, and discharges the air into a tank for subsequent use. In some applications, a hose is attached to the tank and draws the compressed air therefrom. The compressed air may then be used to power a tool that is connected to an opposite end of the hose.

The hoses that attach to compressors can be rigid pipes, flexible coiled hoses, or low- or high-pressure tubing. The tubing type hoses are often stored wound around a reel. A variety of hose reels are available and are capable of storing varying lengths and gauges of hoses. Reels may facilitate winding and compact, ordered storage of the high-pressure and low-pressure hose used, and may range from simple spools to units that are hard-piped to the compressor and provided on a separate base, and/or suspended from a post or ceiling (e.g., in industrial settings).

SUMMARY

Embodiments of the disclosure may provide a compression system. The compression system includes a compressor, and a tank rotatably coupled with the compressor and configured to receive a compressed fluid therefrom. The compression system further includes a sheave configured to receive a hose, with the sheave being coupled with the tank such that the sheave and the tank are rotationally fixed relative to one another and rotatable with respect to the compressor.

Embodiments of the disclosure may also provide a method for manufacturing a compression system. The method includes coupling a tank to a compressor, such that the tank is configured to receive a compressed fluid from the compressor and is rotatable with respect to the compressor. The method further includes coupling a hose sheave to the tank, such that the tank and the hose sheave are prevented from rotation relative to one another and are rotatable together as a single unit with respect to the compressor.

Embodiments of the disclosure may further provide a compression system. The compression system includes a frame, and a compressor coupled to the frame, with the compressor being configured to compress a gas. The compression system also includes an integrated tank and reel assembly that is rotatably coupled to the frame. The integrated tank and reel assembly includes a generally cylindrical tank fluidly coupled to the compressor so as to receive the gas therefrom. Further, the generally cylindrical tank defines a first end, a second end, and a longitudinal axis extending between the first and second ends. The integrated tank and reel assembly also includes a first end wall coupled to the tank proximal the first end, and a second endwall coupled to the tank proximal the second end, such that the first and second endwalls are spaced apart along the longitudinal axis of the tank. The integrated tank and reel assembly is configured to receive a hose between the first and second endwalls, such that the hose is disposed around the tank. The compression system also includes a guide arm defining an opening therethrough, with the opening being configured to receive the hose from the integrated tank and reel assembly. The guide arm is movable between a retracted position and a deployed position and is biased toward the deployed position. The compression system further includes a switch coupled with the guide arm and the compressor. The switch is configured to close when the guide arm is in the deployed position and open when the guide arm is in the retracted position.

BRIEF DESCRIPTION OF THE DRAWINGS

The accompanying drawing, which is incorporated in and constitutes a part of this specification, illustrates an embodiment of the present teachings and together with the description, serves to explain the principles of the present teachings. In the figures.

Figure 1:
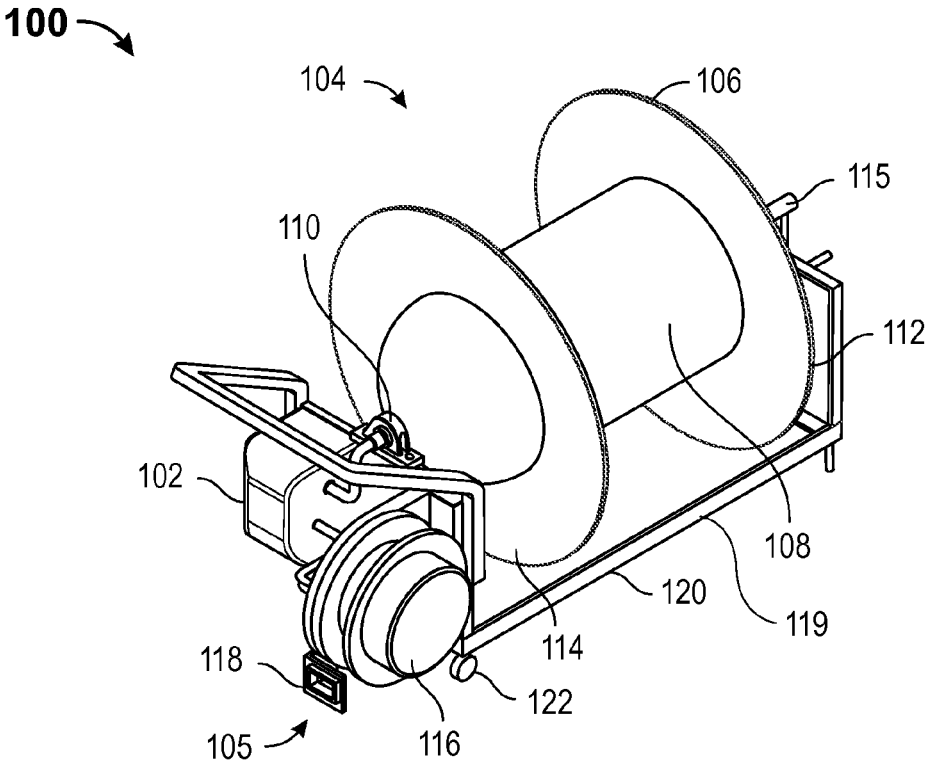
FIG. 1 illustrates a perspective view of a compression system including an integrated reel, according to an embodiment.

It should be noted that some details of the figure have been simplified and are drawn to facilitate understanding of the embodiments rather than to maintain strict structural accuracy, detail, and scale.

DETAILED DESCRIPTION

Reference will now be made in detail to embodiments of the present teachings, examples of which are illustrated in the accompanying drawings. In the drawings, like reference numerals have been used throughout to designate identical elements, where convenient. In the following description, reference is made to the accompanying drawing that forms a part thereof, and in which is shown by way of illustration a specific exemplary embodiment in which the present teachings may be practiced. The following description is, therefore, merely exemplary.

Figure 2:
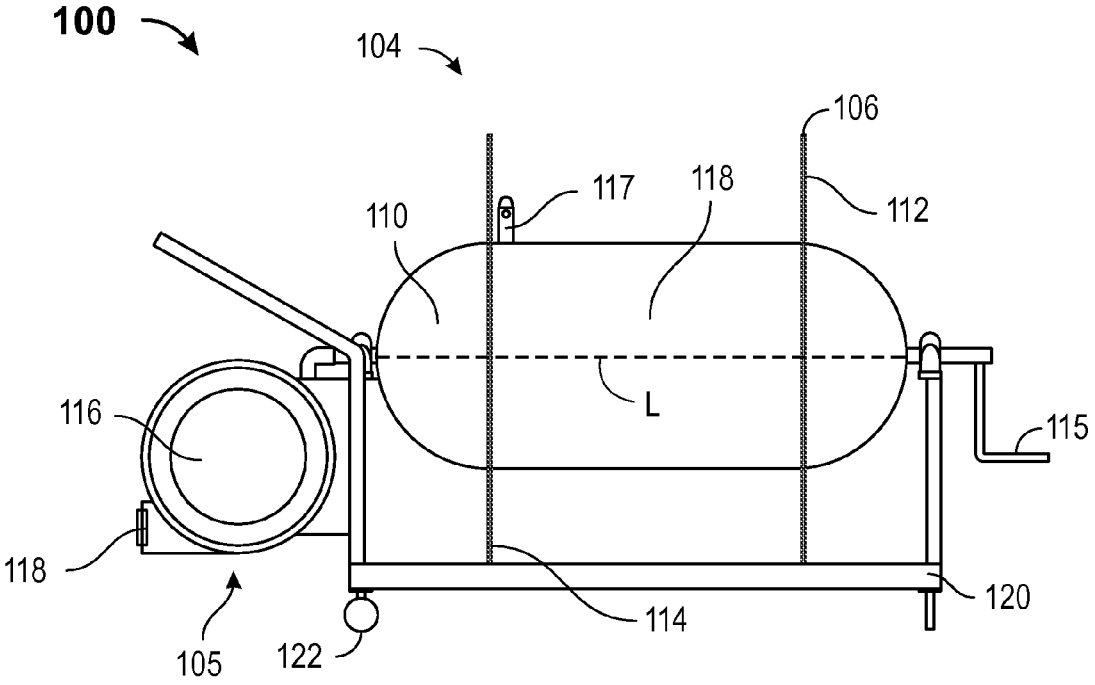
FIG. 2 illustrates a side elevation view of the compression system, according to an embodiment.

FIGS. 1 and 2 illustrate a perspective view and an elevation view, respectively, of a compression system 100, according to an embodiment. The compression system 100 generally includes a compressor 102, an integrated reel and tank assembly 104, and a cord reel 105. The compressor 102 may be any suitable compressor for any application such as, in one example, compressing air for powering a pneumatic tool. The compressor 102 may be a screw, plunger, piston, reciprocating, axial, centrifugal, or any other type of compressor. The compressor 102 may include a motor, which may be electrically driven using AC or DC power, or may include any other type of driver, whether gas powered, diesel powered, or otherwise powered.

The integrated reel and tank assembly 104 may include a sheave 106 and a tank 108. The tank 108 may be coupled with the compressor 102 via a rotatable coupling 110, so as to receive compressed air (or any other fluid) from the compressor 102. The rotatable coupling 110 may maintain a sealed connection between the compressor 102 discharge and the tank 108, while allowing the tank 108 to rotate relative to the compressor 102. The tank 108 and the sheave 106 may be coupled together such that they are prevented from rotation relative to one another. Accordingly, the tank 108 and the sheave 106 may be capable of rotating together (e.g., as a single unit) relative to the compressor 102.

In an embodiment, the tank 108 may form a central portion of the sheave 106, as shown. For example, the sheave 106 may include two disks 112, 114 disposed, e.g., concentrically, about the tank 108 and separated apart along the longitudinal axis L of the tank 108. The disks 112, 114 may serve as endwalls for the sheave 106, so as to retain a length of hose wound around the tank 108 therebetween. In other embodiments, the sheave 106 and the tank 108 may be separate components and may be fixed together. Whether fixed together or integrally formed, either is within the scope of the term "coupled together" as used herein.

Further, the system 100 may include a rotation device 115, which may be a crank employed by a user to manually rotate the tank 108 and sheave 106. In other embodiments, the rotation device 115 may be or include a device that automatically rotates the tank 108 and the sheave 106, for example, a spring (e.g., torsion spring) that is moved from its natural position by rotation of the sheave 106, such as when a length of hose is deployed from the sheave 106. Accordingly, the spring may apply an angular biasing force on the sheave 106 and tank 108 when the hose is deployed. The biasing force may urge the sheave 106 and the tank 108 to retract the hose. In another embodiment, the rotation device 115 may be or include a motor in lieu of or in addition to either or both of a spring or a crank, which may be powered to rotate the tank 108 and sheave 106 to deploy or retract the hose.

The tank 108 may be configured to be coupled to a hose via a hose connection 117. The hose connection 117 may be fixed to the tank 108, so as to rotate with the tank 108. The hose connection 117 may be any suitable type of hose connection, such as a push-lock connection or a threaded connection, either male or female, to which a hose or an adapter may be connected. The hose connection 117 may include any suitable valves, etc., such that air may be released from the tank 108 to the hose on demand, when the hose is attached to the hose connection 117.

The cord reel 105 may include a radiused (e.g., cylindrical) body 116, which may receive and guide a power cord coupled with the compressor 102. Further, the cord reel 105 may include a guide arm 118 with an opening through which the cord may be received The system 100 may also include a base 119 that supports the compressor 102, tank 108, and sheave 106. For example, the base 119 may include a frame 120 that may be made from pipes, beams, etc. The base 119 may also include one more wheels 122, increasing portability of the system 100. The compressor 102 may be fixed to the frame 120, while the sheave 106 and the tank 108 may be individually or together rotatably coupled to the frame 120, and thus to the compressor 102 via the frame 120.

In operation, an end of a hose may be coupled to the hose connection 117, and the hose received into the sheave 106, between the two disks 112, 114 and around the tank 108. To accomplish the receiving, the tank 108 and sheave 106 may be rotated such that, with the end of the hose coupled with the hose connection 117, the hose may be wound around the tank 108 in the sheave 106. The rotation may be accomplished by turning the rotation device 115 either manually (e.g., by the crank) or by operation of a motor and/or spring.

The hose may be deployed from around the tank 108 and in the sheave 106, for example, by a user pulling on a tool end of the hose. Further, during, prior to, and/or after deploying the hose, the compressor 102 may be powered on, so as to supply compressed air into the tank 108. When a tool connected to the hose is activated, air may be drawn from the tank 108 and supplied to the tool, so as to operate the tool. When use of the tool is complete, the hose may once again be received around the tank 108 and in the sheave 106.

Figure 3:
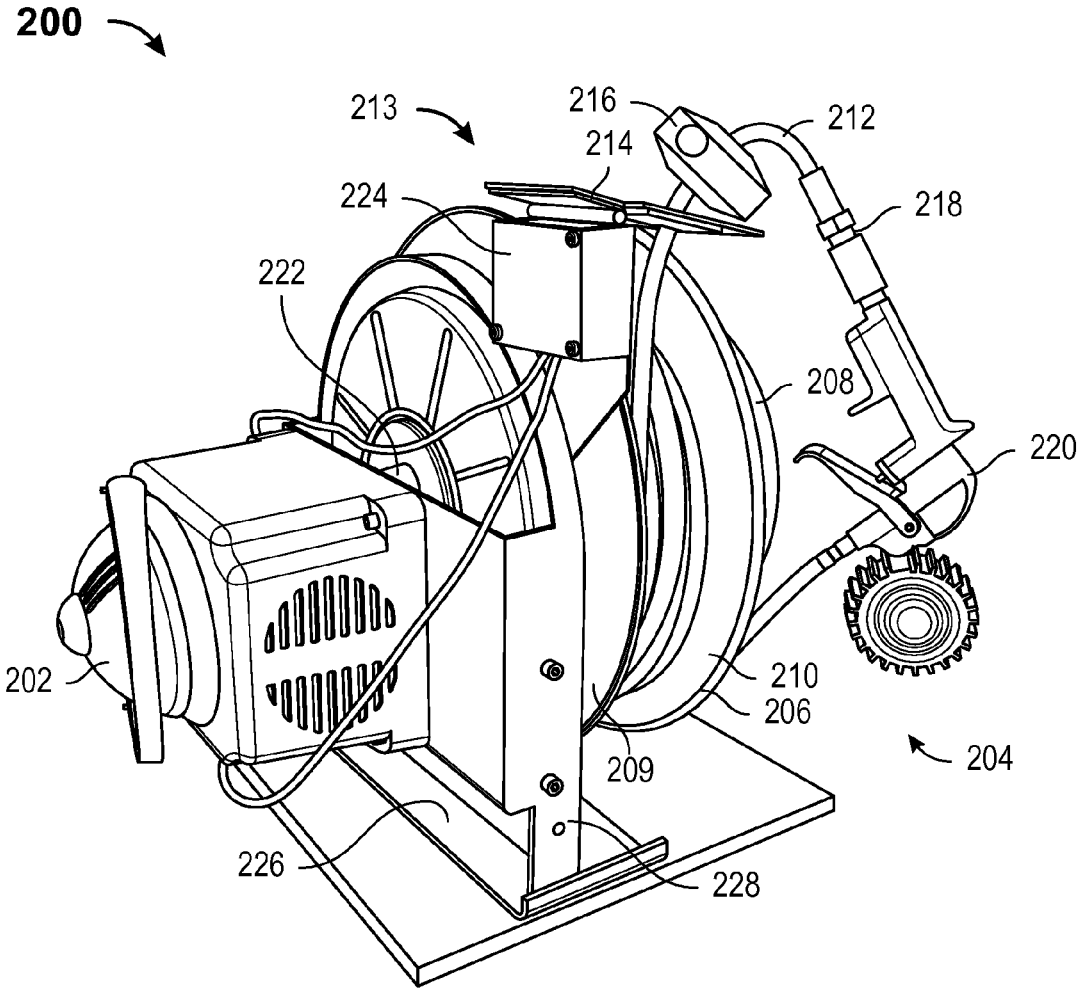
FIG. 3 illustrates a perspective view of another compression system including an integrated reel, according to an embodiment.
Figure 4:
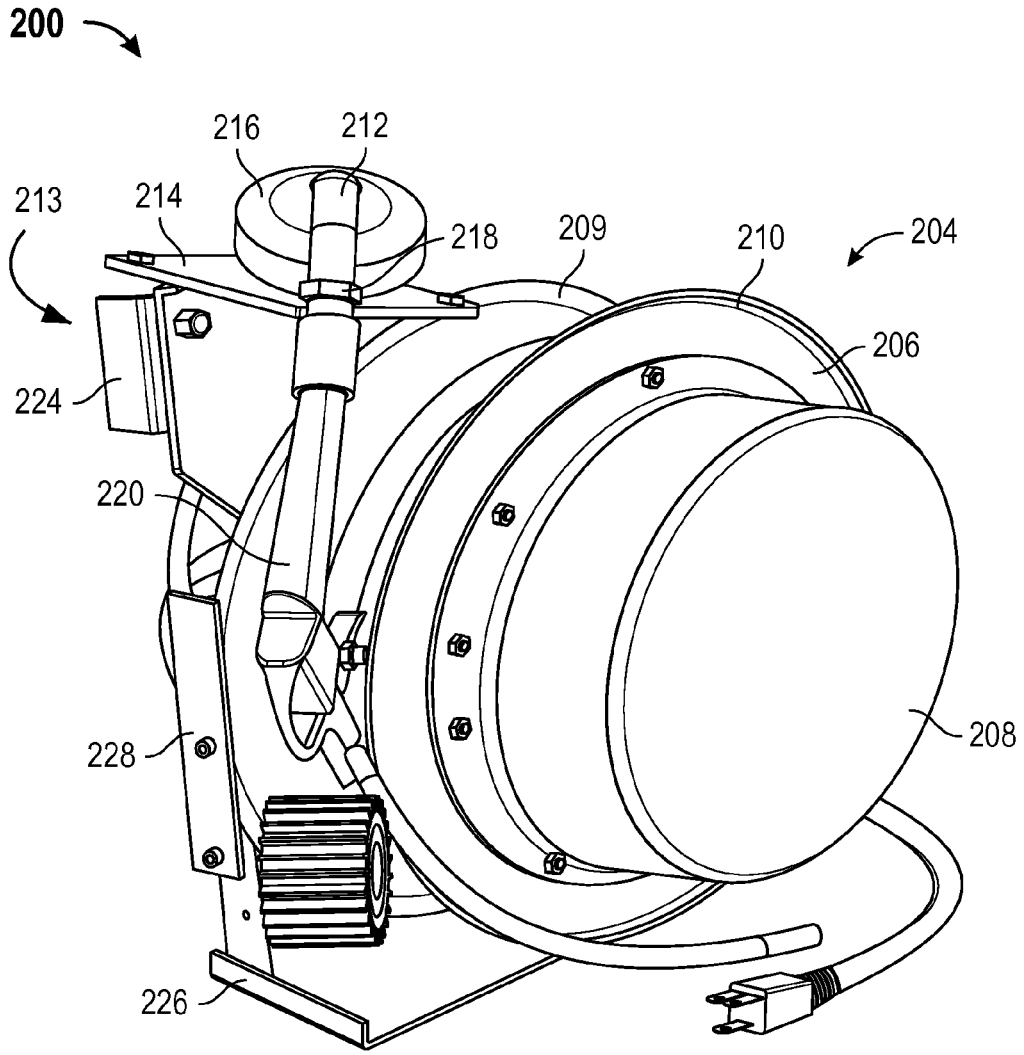
FIG. 4 illustrates another perspective view of the compression system of FIG. 3, according to an embodiment.

FIGS. 3 and 4 illustrate perspective views of another compression system 200, according to an embodiment. The compression system 200 may be generally similar to the compression system 100. Accordingly, the compression system 200 may include one or more compressors 202 of any suitable type and an integrated reel and tank assembly 204 including a sheave 206 and a tank 208. The sheave 206 may include two disks (or "endwalls") 209, 210, between which a hose 212 may be received and wound about a central spool of the sheave 206.

Further, the compression system 200 may include a hose feed module 213. The hose feed module 213 may include a guide arm 214 through which the hose 212 is received and fed to the sheave 206. The hose 212 may include a bumper 216 positioned proximal to a tool end 218 of the hose 212. The bumper 216 may bear on the guide arm 214. Moreover, a pneumatic tool 220, or any other pneumatically-driven device, may be coupled with the hose 212 at the tool end 218.

As shown, the tank 208 may be received on an outside of the sheave 206, which may, for example, facilitate retrofitting and ease of construction of the integrated reel and tank assembly 204. For example, the tank 208 may be coupled (e.g., fastened and/or welded) to an axial face of one of the disks 209, 210, for example, to the axial face of the disk 210 opposite to the compressor 102. Accordingly, one or more fluid passages may extend through the central spool of the sheave 106. One such fluid passage may extend from a rotatable coupling 222 coupled to the compressor 202 discharge to an inlet of the tank 208. Another such fluid passage may extend from the tank 208 to a hose connection, to which the hose 212 may be coupled so as to receive compressed air from the tank 208.

Furthermore, the guide arm 214 may communicate with a switch 224 that is coupled with the compressor 102. For example, a position of the guide arm 214 may determine whether the switch 224 causes power to be interrupted or allows power to be supplied to the compressor 102. In an embodiment, the guide arm 214 may be pivotable from an approximately horizontal, deployed position to an angle to horizontal (e.g., below horizontal, as shown), which may be the retracted position. Further, the guide arm 214 may be biased toward the deployed position, such that in the absence of an external force, the bias is sufficient to move and/or keep the guide arm 214 in the deployed position. In an embodiment, the switch 224 may be closed when the guide arm 214 is in the deployed position.

The compression system 200 may also include a base 226, which may include a frame 228 to which the compressor 102 is fixed and to which the sheave 206 and tank 208 are rotatably coupled. The hose feed module 213 may also be fixed to the frame 228. Moreover, the rotatable coupling between the sheave 206 and the frame 228 may be spring-loaded, such that the sheave 206 is biased angularly against rotation in at least one angular direction. For example, such spring-loaded coupling may be uni-directional, such that rotation in one direction is not opposed by (nor adds to) the biasing force, while rotation in the opposite direction is opposed by, and continual movement adds to, the biasing force. In other embodiments, movement in any direction may be opposed by the biasing force.

In operation, when the hose 212 may be received through the guide arm 214 and into the sheave 206, the biasing force on the sheave 206 may urge the hose 212 to be retracted and further wound into the sheave 206. However, progression of the hose 212 may be arrested by engagement between the bumper 216 and the guide arm 214, as the bumper 216 may be too large to fit through, or otherwise be prevented from traversing past, the guide arm 214. Accordingly, the angular biasing force on the sheave 206 may be translated to linear force in the hose 212, which is applied by the bumper 216 onto the guide arm 214, causing the guide arm 214 to be displaced from horizontal. This may cause the switch 224 to turn off, ceasing or preventing power supply to the compressor 202.

When the tool 220 is deployed, force on the hose 212 may overcome the biasing force applied on the sheave 206. Accordingly, the bumper 216 may be removed from contact with the guide arm 214, and the biasing force on the guide arm 214 may cause the guide arm 214 to return to the deployed (e.g., horizontal) position. The guide arm 214 being in the deployed position may close the switch 224, allowing the compressor 202 to power on and begin compressing and discharging air into the tank 208, unless and until a maximum operating pressure is reached. Thereafter, the compressor 202 may turn on to recharge the tank 208 during use of the tool 220.

When the use of the tool 220 is complete, the deployed hose 212 may be received back into the sheave 206. Such receiving may proceed by removing opposition of the biasing force from the hose 212, thereby allowing the biasing force to cause the sheave 206 to rotate and draw in the hose 212. In other embodiments, a rotation device (e.g., the rotation device 115 described above), motor, pneumatic device employing the compressed air in the tank 208, or any other device may be employed to cause the sheave 206 to rotate. In such an embodiment, the bumper 216 engaging the guide arm 214 may cause another switch to actuate, thereby causing the device rotating the sheave 206 to be powered down.

Figure 5:
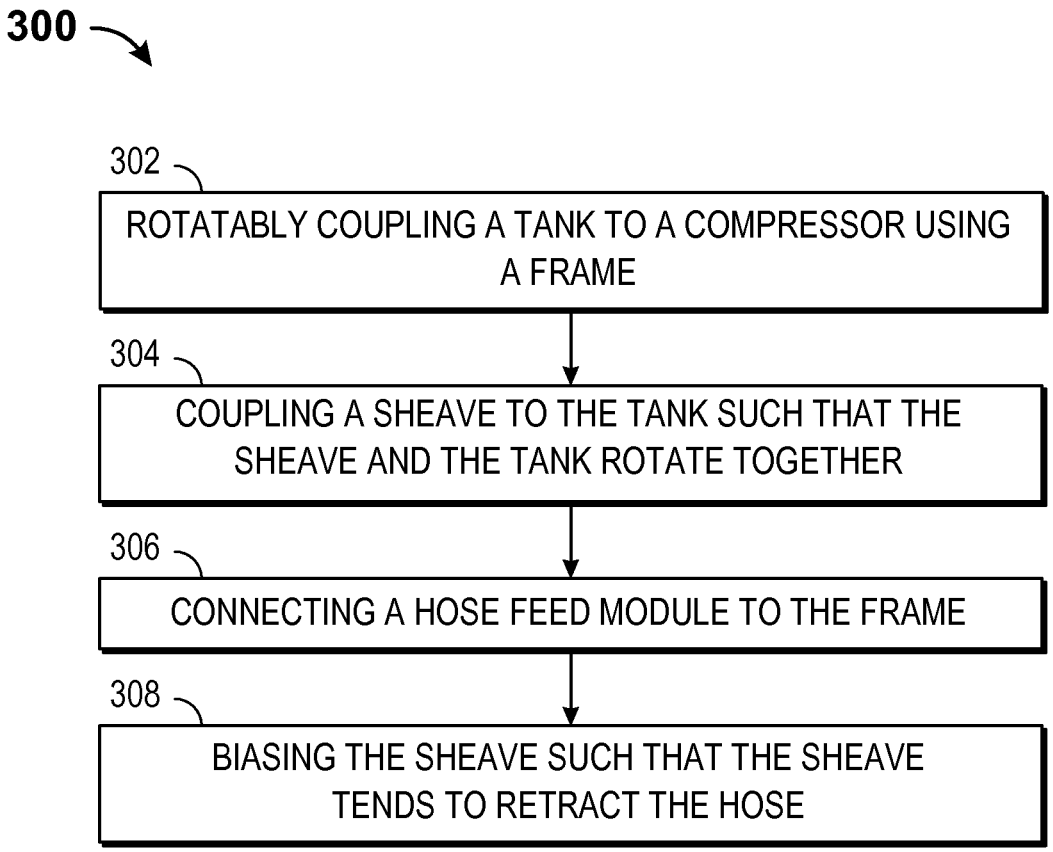
FIG. 5 illustrates a method of manufacturing a compression system, according to an embodiment.

FIG. 5 illustrates a flowchart of a method 300 for manufacturing a compression system, according to an embodiment. In some embodiments, the method 300 may include manufacturing one or more embodiments of the compression system 100, 200 and thus may be best understood with reference thereto. However, it will be appreciated that the method 300 is not limited to any particular structure unless otherwise expressly stated herein.

Accordingly, with additional reference to FIGS. 1-4, the method 300 may begin by rotatably coupling a tank 108 to a compressor 102, as at 302. For example, a rotatable coupling 110 may be employed to fluidly connect the gas discharge of the compressor 102 to the tank 108, such that the tank 108 receives and stores the compressed gas from the compressor 102. The method 300 may also include coupling a hose sheave 106 to the tank 108, such that the tank 108 and the hose sheave 106 are rotatable as a single unit with respect to the compressor 102, as at 304. In an embodiment, the coupling at 304 may include coupling two disks 112, 114 of the hose sheave 106 to the tank 108, such that the tank 108 forms a central portion of the hose sheave 106.

In another embodiment (e.g., as shown in FIGS. 3 and 4), the coupling at 304 may include coupling the tank 208 to a first endwall 210 of the sheave 206. In such an embodiment, the sheave 206 may also include a second endwall 209, with the second endwall 209 being positioned between the first endwall 210 and the compressor 202; further, the first endwall 210 may be positioned between the tank 108 and the second endwall 209. The hose 212 may be received into the sheave 206 between the endwalls 209, 210 thereof.

The method 300 may also include connecting a hose feed module 213 to a frame 228 rotatably coupled to the sheave 206, as at 306. The hose feed module 213 may include a movable guide arm 214 configured to receive a hose 212 received onto the sheave 206. In such an embodiment, the method 300 may also include electrically coupling the guide arm 214 with the compressor 202, for example, using a switch 222. The guide arm 214 and/or switch 222 may be configured such that movement of the guide arm 214 from a retracted (flexed/angled) position to a deployed (horizontal) position allows the compressor 202 to be powered on. For example, the switch 222 may open an electrical circuit electrically connecting the compressor 202 with a power source when the guide arm 214 is in the retracted position, thereby blocking transmission of power to the compressor 202. When the guide arm 214 is in the deployed position, the switch 224 may close the circuit, which may allow the compressor 2 to turn on. However, it will be appreciated that other switches and/or other circuits may be employed in addition to the switch 224 (e.g., a pressure control switch) that may prevent the compressor 202 from powering on, when the guide arm 214 is in the deployed position.

The method 300 may further include biasing the sheave 206 such that the sheave tends to retract the hose 212, as at 308. The biasing of the sheave 206 at 308 may apply a force on the guide arm 214, for example, via transmission through the hose 212 and the bumper 216. Such biasing force may overcome the biasing force on the guide arm 214, causing the guide arm 214 to move from the deployed position to the retracted position, when the hose 212 is retracted. In some embodiments, in addition to or in lieu of such biasing, the method 300 may include coupling a rotation device 115 (e.g., FIG. 1) such as a crank, spring, or motor to the sheave, so as to rotate the sheave 206.

While the present teachings have been illustrated with respect to one or more implementations, alterations and/or modifications may be made to the illustrated examples without departing from the spirit and scope of the appended claims. In addition, while a particular feature of the present teachings may have been disclosed with respect to only one of several implementations, such feature may be combined with one or more other features of the other implementations as may be desired and advantageous for any given or particular function. Furthermore, to the extent that the terms "including," "includes," "having," "has," "with," or variants thereof are used in either the detailed description and the claims, such terms are intended to be inclusive in a manner similar to the term "comprising." Further, in the discussion and claims herein, the term "about" indicates that the value listed may be somewhat altered, as long as the alteration does not result in nonconformance of the process or structure to the illustrated embodiment. Finally, "exemplary" indicates the description is used as an example, rather than implying that it is an ideal.

Other embodiments of the present teachings will be apparent to those skilled in the art from consideration of the specification and practice of the present teachings disclosed herein. It is intended that the specification and examples be considered as exemplary only, with a true scope and spirit of the present teachings being indicated by the following claims.

What is claimed is:

1. A compression system, comprising:

a compressor;

a tank rotatably coupled with the compressor and configured to receive a compressed fluid therefrom;

a sheave configured to receive a hose, the sheave being coupled with the tank such that the sheave and the tank are rotationally fixed relative to one another and rotatable with respect to the compressor; and a guide arm coupled with the compressor and configured to receive the hose, wherein the guide arm is movable between a retracted position and a deployed position, and wherein the compressor is prevented from powering on when the guide arm is in the retracted position.

2. The compression system of claim 1, wherein the tank and the sheave are fixed together and rotatable as a single unit.

3. The compression system of claim 1, wherein the tank forms a central portion of the sheave, such that the hose is wound around the tank when the sheave receives the hose.

4. The compression system of claim 3, wherein the sheave comprises first and second endwalls that are coupled with the tank and separated apart along a longitudinal axis of the tank, wherein the sheave is configured to receive the hose between the first and second endwalls.

5. The compression system of claim 1, wherein the sheave comprises a first endwall, wherein the tank is coupled with the first endwall so as to rotate therewith.

6. The compression system of claim 5, wherein the sheave further comprises a second endwall spaced apart from the first endwall, wherein the second endwall is disposed between the first endwall and the compressor.

7. The compression system of claim 1, further comprising a frame coupled to the compressor and rotatably coupled with the sheave, the tank, or both the sheave and the tank.

8. The compression system of claim 1, wherein the guide arm is biased by a first biasing force toward the deployed position.

9. The compression system of claim 8, wherein the sheave is angularly biased by a second biasing force, such that the sheave is biased toward retracting the hose, wherein, when the hose is retracted, the second biasing force on the sheave is transmitted to the guide arm via the hose, wherein the second biasing force on the sheave is larger than the first biasing force on the guide arm.

10. A method for manufacturing a compression system, comprising:

coupling a tank to a compressor, such that the tank is configured to receive a compressed fluid from the compressor and is rotatable with respect to the compressor;

coupling a hose sheave to the tank, such that the tank and the hose sheave are prevented from rotation relative to one another and are rotatable together as a single unit with respect to the compressor;

connecting a hose feed module to a frame that is rotatably coupled to the hose sheave, the tank, or both, wherein the hose feed module comprises a movable guide arm configured to receive a hose received onto the hose sheave; and electrically coupling the guide arm with the compressor, such that movement of the guide arm from a retracted position to a deployed position allows the compressor to be powered on.

11. The method of claim 10, wherein coupling the tank to the compressor comprises fixedly coupling the compressor to a frame and rotatably coupling the tank, the hose sheave, or both to the frame.

12. The method of claim 10, wherein coupling the hose sheave to the tank comprises coupling two endwalls of the hose sheave to the tank, such that the tank forms a central portion of the sheave.

13. The method of claim 10, wherein coupling the hose sheave to the tank comprises coupling a first endwall of the sheave to the tank, wherein a second endwall of the sheave is positioned between the first endwall and the compressor.

14. The method of claim 10, further comprising biasing the hose sheave such that the sheave is urged to retract the hose, wherein the biasing of the hose sheave applies a force on the guide arm, moving the guide arm from the deployed position to the retracted position, when the hose is retracted.

15. The method of claim 10, further comprising coupling a rotation device to the hose sheave, so as to rotate the hose sheave, wherein the rotation device is selected from the group consisting of a crank, a spring, and a motor.

16. A compression system, comprising:

a frame;

a compressor coupled to the frame, the compressor configured to compress a gas;

an integrated tank and reel assembly rotatably coupled to the frame, the integrated tank and reel assembly comprising:

a generally cylindrical tank fluidly coupled to the compressor so as to receive the gas therefrom, the generally cylindrical tank defining a first end, a second end, and a longitudinal axis extending between the first and second ends;

a first endwall coupled to the tank proximal the first end; and a second endwall coupled to the tank proximal the second end, such that the first and second endwalls are spaced apart along the longitudinal axis of the tank, wherein the integrated tank and reel assembly is configured to receive a hose between the first and second endwalls, such that the hose is disposed around the tank;

a guide arm defining an opening therethrough, the opening configured to receive the hose from the integrated tank and reel assembly, the guide arm being movable between a retracted position and a deployed position and being biased toward the deployed position; and a switch coupled with the guide arm and the compressor, wherein the switch is configured to close when the guide arm is in the deployed position and open when the guide arm is in the retracted position.

* * * * *